United States Patent [19]

Tsai et al.

[11] Patent Number: 4,927,664

[45] Date of Patent: May 22, 1990

[54] PROCESS FOR APPLYING ELECTRICALLY INSULATIVE LAYERS

[75] Inventors: Chong S. Tsai; Shou H. Chen; Bean T. Li; King L. Jean, all of Hsinchu, Taiwan

[73] Assignee: Industrial Technology Research Institute, Taiwan

[21] Appl. No.: 324,212

[22] Filed: Mar. 15, 1989

[51] Int. Cl.[5] ..... B05D 3/12

[52] U.S. Cl. ..... 427/57; 427/104; 427/127; 427/178; 427/180; 427/376.4; 427/376.5

[58] Field of Search ..... 427/57, 104, 127, 178, 427/180, 376.4, 376.5

[56] References Cited

U.S. PATENT DOCUMENTS 3,211,577 10/1965 Forslund ..... 427/104
4,812,856 3/1989 Wallace ..... 427/57

FOREIGN PATENT DOCUMENTS 2353593 5/1974 Fed. Rep. of Germany ..... 427/57

*Primary Examiner*—Stanley Silverman
*Attorney, Agent, or Firm*—Scully, Scott, Murphy & Presser

[57] ABSTRACT

A process for applying an electrically insulative layer on a metal surface which comprising suspending an electrically insulative powder in a highly volatile solvent by ultrasonic vibration to give a suspension, applying said suspension on the surface of said metal surface, and then evaporating said solvent, leaving an electrically insulative layer consisting of said insulative powder.

3 Claims, No Drawings

PROCESS FOR APPLYING ELECTRICALLY INSULATIVE LAYERS

BACKGROUND OF THE INVENTION

In the production of transformers and magnetic cores (such as a saturable core), insulative layers are required between layers of the iron core such that the eddy currents which occur when the core is working under high frequency may be minimized. Conventional process of applying insulative layers comprises painting a polymer-containing insulative coating followed by baking the coating. Since the polymeric constituents of the insulative coating will be scorched if the baking temperature is too high, the thus produced iron core needs not be subjected to further heat-treatment which is necessary for cores made of certain materials (especially amorphous metals) after the insulative layers are applied. Furthermore, baking step will incur further cost.

JP No. 62057677 discloses an insulative thin layer formed on the surface of an amorphous alloy film. An aqueous solution containing mainly lithium silicate is painted on the surface and baked.

JP No. 62056578 discloses a protective layer on the surface of an amorphous alloy strip coated by applying an aqueous treatment liquid containing colloidal alumina hydrate and then firing (baking) the liquid at low temperature of 200° C.

EP No. 0191447 discloses a process of sputtering layers of magnetic and insulative materials to give a tape contact surface of a magnetic head. The insulative materials include MgO, NiO, MgO-MnO, MgO-TiO, $SrO-TiO_2$, NiO-TiO-MnO, $ZnO-Fe_2O_3$. JP No. 61008903 discloses a process to apply a reducing agent containing chromate on the surface of an amorphous alloy thin band. A chemical process was adopted to form an insulative coating on the surface. The metal bands, however, will unavoidably be adversely affected.

U.S. Pat. No. 4,558,297 discloses a process comprising coiling a thin strip of amorphous metal alloy, which is previously heat treated, and interposing an insulative film of organic material between the coiled layers thereof.

JP No. 59211579 discloses a process in which an aqueous acid solution containing chromic acid, phosphoric acid and a fluorine-containing compound is applied on the surface of an amorphous alloy and then baked to form an insulative coating based on chromate and phosphate.

JP No. 59177377 discloses a process in which an alcohol solution of ethyl silicate added with an acid is applied onto the surface of an amorphous alloy and then dried to from an insulative coating layer.

These and other processes of applying insulating layers all involve complex operations. For example, firing or baking is frequently required. Many ingredients are added to ensure homogeneity of the formed insulative layer. The insulated coil or amorphous layers cannot be further heat treated.

SUMMARY OF THE INVENTION

It is an object of the present invention to provide a simple process for applying insulative layers between layers of iron core without baking such that the iron core can be further heat-treated and the insulative layers are more evenly applied.

The present invention provides a process for applying an electrically insulative layer on a metal surface comprising suspending an electrically insulative powder in a highly volatile solvent by ultrasonic vibration to give a suspension, applying said suspension on the surface of said metal surface, and then evaporating said solvent, leaving an electrically insulative layer consisting essentially of said insulative powder.

DETAILED DESCRIPTION OF THE INVENTION

While this specification concludes with claims particularly pointing out and distinctly claiming that which is considered to be the invention, it is believed that the invention can be better understood from a reading of the following detailed description of the invention and the appended examples.

The electrically insulative powder used in the present invention is the only constituent of the resultant insulative layer. Since no severe operation conditions are involved in the present process, any insulative powder capable of providing sufficient insulation can be employed. These insulative powders include metal oxides such as aluminium oxide, titanium oxide, strontium oxide, nickel oxide, manganese oxide, zinc oxide, magnesium oxide and silicon oxide.

The highly volatile solvent used in the present invention may be any solvent capable of rapid evaporation in air at room temperature. Methanol, ethanol, acetone, chloroform, tetrafluoroethane are preferred.

The insulative powders are suspended in the solvent with the aid of ultrasonic vibration. After suspension, a homogeneous suspension is obtained. As a result of the effect of the ultrasonic vibration, the suspension thus produced will keep homogeneous for at least 24 hours. The suspension is then coated on the surface of a metal band by brushing or spraying or any conventional process. The highly volatile solvent will evaporate automatically or with the aid of the air from the spraying nozzle, leaving a homogeneous layer of electrically insulative layer. The metal band can then be coiled with the insulative layer interposed between coils.

The present invention finds its greatest use in the production of the iron core of a magnetic core. The formation of eddy currents in the iron core will lower the performance of a magnetic core, especially when the magnetic core is working under high frequency. A satisfactory insulative layer is critical to the prevention or minimization of eddy currents.

The following examples are offered to aid in understanding of the present invention and are not to be construed as limiting the scope thereof. Unless otherwise indicated, all parts and percentages are by weight.

EXAMPLE

Aluminium oxide powder of particle size of about 0.4 μm was dispersed in acetone in the concentration of 300 c.c.:6 g. Ultrasonic wave was applied by BRANSONIC Ultrasonic Cleaner to produce a stable suspension. This takes about 30 minutes. The resulting suspension was sprayed onto an amorphous metal ribbon. After the acetone evaporated, an insulative layer was formed on the surface of the amorphous metal ribbon. The ribbon was then coiled to give a magnetic core for test. A control magnetic core was prepared without the addition of insulative layer. The cores were tested for core loss under an induction of 0.5 Tesla and a frequency of 20 kHz. The core loss of the magnetic core of the present example was 0.2 W/g while that of the control sample was 0.4 W/g.

We claim:

1. A process for applying an electrically insulative layer on a metal surface which comprises suspending an electrically insulative powder in a highly volatile solvent by ultrasonic vibration to give a homogeneous suspension, applying said suspension on the surface of said metal surface, and then evaporating said solvent, leaving an electrically insulative layer consisting essentially of said insulative powder.

2. The process as claimed in claim 1, wherein said insulative powder is selected from the group consisting of aluminium oxide, titanium oxide, strontium oxide, nickel oxide, manganese oxide, zinc oxide, magnesium oxide and silicon oxide.

3. The process as claimed in claim 1 or 2, wherein said solvent is selected from the group consisting of methanol, ethanol, acetone, chloroform, tetrafluoroethane, and any combination thereof.

* * * * *

UNITED STATES PATENT AND TRADEMARK OFFICE

CERTIFICATE OF CORRECTION

PATENT NO. : 4,927,664

DATED : May 22, 1990

INVENTOR(S) : Chong-Sheng Tsai, et al.

It is certified that error appears in the above-identified patent and that said Letters Patent is hereby corrected as shown below:

Column 3, line 7, Claim 1: after "insulative" add --metal oxide--

Column 3, lines 7-8, Claim 1: after "solvent" add --capable of rapid evaporation in air at room temperature--

Column 4, line 4, Claim 2: after "insulative" add --metal oxide--

Column 4, line 4, Claim 2: after "powder" delete "is selected from the group consisting of" and after --powder" add --is--

Column 4, line 8, Claim 3: "claim 1 or 2" should read as --anyone of claims 1 or 2,--

Column 4, line 9, Claim 3: delete "selected from the group consisting of"

Column 4, line 10, Claim 3: "chloroform, tetrafluoroethane, and" should read as --chloroform or tetrafluoroethane, or any--

Signed and Sealed this

Third Day of September, 1991

*Attest:*

*Attesting Officer*

HARRY F. MANBECK, JR.

*Commissioner of Patents and Trademarks*

UNITED STATES PATENT AND TRADEMARK OFFICE

CERTIFICATE OF CORRECTION

PATENT NO. : 4,927,664

DATED : May 22, 1990

INVENTOR(S) : Chong-Sheng Tsai, et al.

It is certified that error appears in the above-identified patent and that said Letters Patent is hereby corrected as shown below:

On the Title page, Section [75]: "Bean T. Li" should read as --Bean J. Li--

Signed and Sealed this

Seventeenth Day of December, 1991

*Attest:*

HARRY F. MANBECK, JR.

*Attesting Officer*

*Commissioner of Patents and Trademarks*